US010544607B2

(12) United States Patent
Lange

(10) Patent No.: US 10,544,607 B2
(45) Date of Patent: Jan. 28, 2020

(54) SYSTEM AND METHOD FOR CONTROLLING A VEHICLE DOOR

(71) Applicant: GM GLOBAL TECHNOLOGY OPERATIONS LLC, Detroit, MI (US)

(72) Inventor: Richard J. Lange, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 432 days.

(21) Appl. No.: 15/380,295

(22) Filed: Dec. 15, 2016

(65) Prior Publication Data

US 2018/0171684 A1 Jun. 21, 2018

(51) Int. Cl.
*E05B 81/76* (2014.01)
*E05B 81/70* (2014.01)
*E05B 81/58* (2014.01)

(52) U.S. Cl.
CPC ..... *E05B 81/76* (2013.01); *E05B 81/58* (2013.01); *E05B 81/70* (2013.01)

(58) Field of Classification Search
CPC ..... E05Y 2400/44; E05Y 2400/45; E05Y 2400/32; E05Y 2400/40; E05Y 2400/852; E05B 81/58; E05B 81/76; E05B 81/14; E05B 81/64; E05F 15/60; E05F 15/659
See application file for complete search history.

(56) References Cited

U.S. PATENT DOCUMENTS

2010/0064588 A1* 3/2010 Jitsuishi ..... E05B 81/20 49/358
2011/0154740 A1* 6/2011 Matsumoto ..... E05B 79/20 49/359
2011/0276196 A1* 11/2011 Nishikawa ..... B60R 25/245 701/2
2013/0076048 A1* 3/2013 Aerts ..... E05B 85/103 292/336.3
2014/0001771 A1* 1/2014 Shibayama ..... E05B 81/14 292/100
2014/0340808 A1* 11/2014 Kurita ..... H01H 47/002 361/170

(Continued)

FOREIGN PATENT DOCUMENTS

CN 101949241 A 1/2011
CN 104903937 A 9/2015
CN 105034975 A 11/2015

(Continued)

*Primary Examiner* — Mark A Williams
(74) *Attorney, Agent, or Firm* — Quinn IP Law

(57) ABSTRACT

A system and method of controlling operation of a vehicle door assembly for a vehicle includes monitoring a door handle sensor to detect at least one open request generated by the door handle. A first control signal is transmitted by a controller to a door unlatching actuation mechanism in response to a first open request. The door unlatching actuation mechanism is actuated for a first time period T1 in response to the first control signal. A door position sensor is monitored by the controller and determines the position of the door at completion of the first time period T1. The controller transmits a second control signal to actuate the door unlatching actuation mechanism for a second time period T2 in response to a second open request when the door position sensor detects the door in the closed position at the completion of the first time period T1.

17 Claims, 2 Drawing Sheets

(56) References Cited

U.S. PATENT DOCUMENTS

2015/0059250 A1* 3/2015 Miu ..... E05F 15/611
49/349

FOREIGN PATENT DOCUMENTS

| | | | |
|---|---|---|---|
| CN | 105421907 | A | 3/2016 |
| CN | 105604405 | A | 5/2016 |
| JP | 2008240415 | A | 10/2008 |
| JP | 2015200617 | A | 11/2015 |

* cited by examiner

SYSTEM AND METHOD FOR CONTROLLING A VEHICLE DOOR

INTRODUCTION

The present disclosure generally relates to a system and method for controlling operation of a vehicle door assembly.

An automotive closure, such as a door for a vehicle passenger compartment, is hinged to swing between open and closed positions and conventionally includes a door latch that is housed between inner and outer panels of the door. Vehicle doors generally include a door latch to secure the door to the body of the vehicle, and a door latch system to engage and unlatch the door latch, and prevent the door from being opened from an exterior of the vehicle. When the door latch system is disposed in an unlatched state, the door may be opened from the interior of the vehicle by operating an interior door handle.

Latching systems of vehicles have undergone numerous changes over the years. Some of the current latching systems have been redesigned with electronic switches to replace interior and exterior latch handle assemblies, which were previously formed of numerous mechanical parts. Power latch systems include a power system that electrically actuates the latching and unlatching of the door.

SUMMARY

A system and method of controlling operation of a vehicle door assembly for a vehicle is provided. The method of controlling at least one door of a vehicle includes monitoring, with a controller, a door handle sensor operatively connected to a door handle and disposed on the at least one door to detect at least one open request generated by the door handle. A first control signal is transmitted by the controller to a door unlatching actuation mechanism in response to a first open request from the door handle. The door unlatching actuation mechanism is actuated for a first time period T1 in response to the first control signal.

A door position sensor is monitored by the controller and is operatively connected to the door unlatching actuation mechanism to detect movement of the door between a closed position and at least one open position. The door position sensor determines the position of the door at completion of the first time period T1 with the door position sensor. The controller transmits a second control signal to actuate the door unlatching actuation mechanism for a second time period T2 in response to a second open request from the door handle sensor when the door position sensor detects the door in the closed position at the completion of the first time period T1.

The method of controlling operation of the vehicle door includes providing a door operation counter in communication with the controller to determine a number N of open requests detected by the door handle sensor, wherein N is an integer greater than zero. The controller transmits the first control signal to actuate the door unlatching actuation mechanism for the first time period in response to the door operation counter N value of one. The first time period T1 used for the first control signal to actuate the door unlatching actuation mechanism is about 200 milliseconds.

The controller transmits the second control signal to actuate the door unlatching actuation mechanism for the second time period T2 in response to the door operation counter N value of two. The second time period T2 used for the second control signal to actuate the door unlatching actuation mechanism is the first time period T1 increased by a value X, wherein X is a time value measured in milliseconds. The time value X used for the second time period T2 is about 100 milliseconds.

In another embodiment, a door unlatching system for a vehicle having a vehicle body defining a vehicle interior and a plurality of doors configured to selectively open and close at least one entryway into the vehicle interior includes a door handle disposed on each of the plurality of doors. A door unlatching actuation mechanism is operatively connected to the door handle and coupled to each of the plurality of doors. A controller is operatively connected with the door handle and door unlatching actuation mechanism.

A plurality of sensors is in communication with the controller. The plurality of sensors includes a door handle sensor monitoring actuation of the door handle and a door position sensor monitoring the position of the door between the closed and open position. The controller monitors the door handle sensor to detect at least one open request generated by the door handle and transmits a first control signal to the door unlatching actuation mechanism in response to a first open request.

The controller actuates the door unlatching actuation mechanism for a first time period T1 in response to the first control signal and monitors the door position sensor to detect movement of the door between a closed position and at least one open position. The controller determines the position of the door at completion of the first time period T1 with the door position sensor.

The first time period T1 used for the first control signal to actuate the door unlatching actuation mechanism is about 200 milliseconds. The door unlatching system includes a door operation counter in communication with the controller to determine a number N of open requests detected by the door handle sensor, wherein N is an integer greater than zero. The controller transmits a second control signal to actuate the door unlatching actuation mechanism for a second time period T2 in response to a second open request from the door handle sensor when the door position sensor detects the door in the closed position at the completion of the first time period T1.

The controller transmits the second control signal to actuate the door unlatching actuation mechanism for the second time period T2 in response to the door operation counter N value of two. The second time period T2 used for the second control signal to actuate the door unlatching actuation mechanism is the first time period T1 increased by a value X, wherein X is a time value measured in milliseconds and the time value X used for the second time period T2 is about 100 milliseconds.

The above features and advantages and other features and advantages of the present disclosure are readily apparent from the following detailed description of the best modes for carrying out the disclosure when taken in connection with the accompanying drawings.

DETAILED DESCRIPTION

Figure 1:
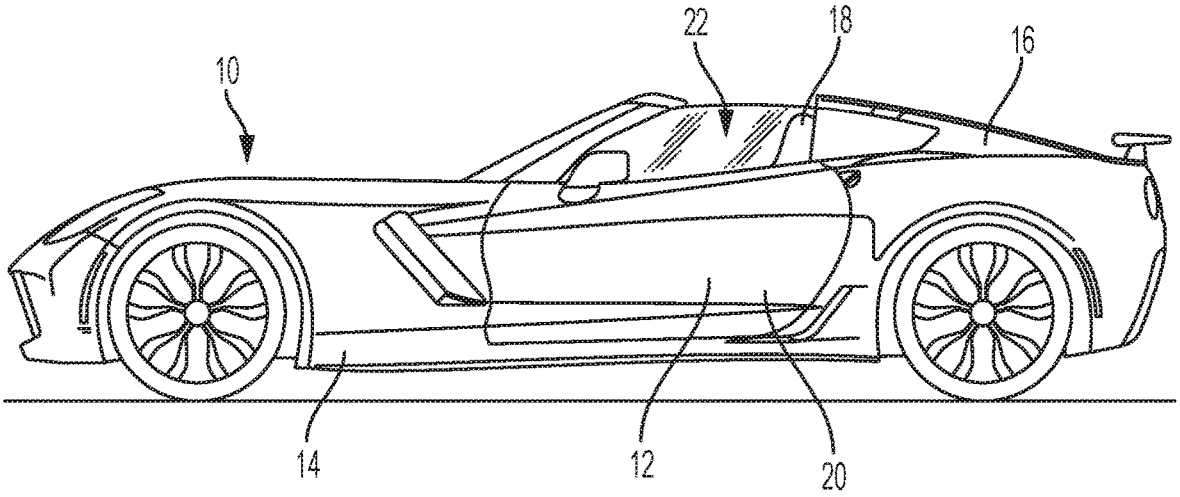
FIG. 1 is a side view of a vehicle incorporating a control system in a vehicle door assembly accordance with the present disclosure.

Reference will now be made in detail to several embodiments of the disclosure that are illustrated in accompanying drawings. Whenever possible, the same or similar reference numerals are used in the drawings and the description to refer to the same or like parts or steps. The drawings are in simplified form and are not to precise scale. For purposes of convenience and clarity, directional terms such as top, bottom, left, right, up, over, above, below, beneath, rear, and front, may be used with respect to the drawings. These and similar directional terms are not to be construed to limit the scope of the disclosure.

Referring to the drawings, wherein like reference numbers correspond to like or similar components throughout the several Figures, a vehicle 10 and a vehicle door assembly 12 are generally shown in FIG. 1. The vehicle door assembly or door 12 can be utilized in a vehicle application or a non-vehicle application. The vehicle 10 may be a mobile platform, including a motorized vehicle, such as, but not limited to, standard passenger cars, sport utility vehicles, light trucks, heavy duty vehicles, minivans, buses, transit vehicles, bicycles or other transportation device. Non-limiting examples of the non-vehicles can include robots, machines, farm implements or any other suitable non-vehicle.

In the vehicle application, for example as shown in FIG. 1, the vehicle 10 can include a body 14 defining a passenger compartment 16. Generally, the passenger compartment 16 is accessible by one or more doors 12. Therefore, when a passenger desires to enter or exit the passenger compartment 16, the passenger opens or closes the door 12 to allow ingress or egress. As such, the doors 12 are movable between an open position and a closed position relative to the passenger compartment 16.

The doors 12 can be opened from the inside by an inner door handle (not shown) and/or may be opened from the outside by a first or exterior door handle 18. The vehicle 10 and/or the door 12 includes an inner panel (not shown) and an outer panel 20 coupled to each other to define the door 12. The outer panel 20 of the door 12 has an outer surface visible from outside of the passenger compartment 16. The inner panel and the outer panel 20 may be arranged to define a cavity between the inner and outer panels to receive a window assembly 22 that may be movable relative to the inner panel and outer panel 20 into and out of the cavity.

It is understood that the first handle 18 described above may include a handle, switch, actuator or the like that cooperates with and is operatively connected to one or more components of the door 12. The second or interior door handle may be operated from an interior portion or area of the vehicle passenger compartment 16 of the vehicle 10 in which a driver or passenger may be positioned, for example, a front row of the vehicle 10, one or more rear rows of the vehicle 10, and/or a hatch or storage region behind the rear rows.

Figure 2:
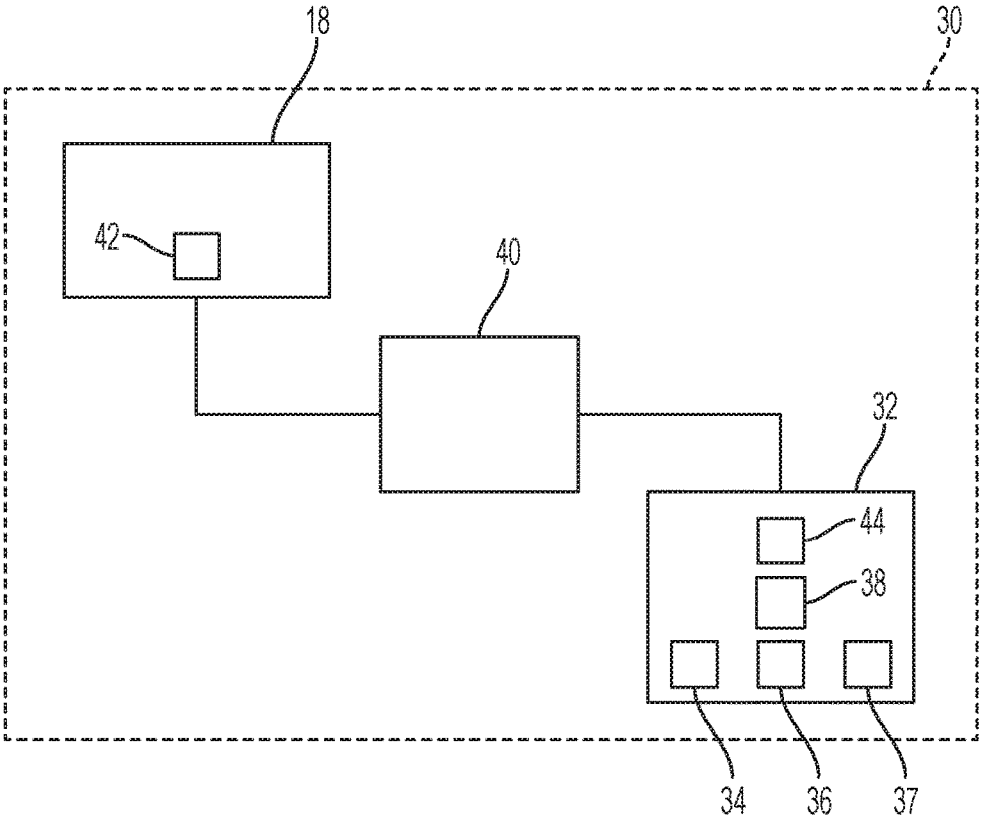
FIG. 2 is a functional block diagram of the door control system that may be used in connection with the vehicle door assembly of FIG. 1.

Referring now to FIG. 2, the vehicle 10 may include a door control system 30, also referred to herein as a control system 30, which implements a door unlatching actuation mechanism 32 for the door 12 of the vehicle 10. In one or more embodiments of the disclosure, the control system 30 takes appropriate actions when the control system 30 detects that an apparatus of a door 12, such as the first handle 18, is operated from outside the vehicle 10.

The control system 30 is operatively connected to the first handle 18. In one non-limiting example, the first handle 18 is selectively movable or engageable to actuate a door unlatching actuation mechanism 32 to release the door 12 from a closed position wherein the door 12 is at least partially disposed adjacent an opening in the vehicle body 14 to a fully opened position and to any intermediate position therebetween, for example, to a position where the door 12 is slightly ajar or is partially opened relative to the vehicle body 14.

The control system 30, in response to the engagement, activation and/or actuation of the first handle 18, selectively instructs the actuation of the door unlatching actuation mechanism 32. The door unlatching actuation mechanism 32 is operatively attached to a portion of the door 12 and is configured with an opening in the exterior of the door 12 through which a striker or other engageable component 34 is introduced to the door unlatching actuation mechanism 32 when the door 12 is in a closed position. The control system 30 is configured to selectively actuate the door unlatching actuation mechanism 32 to prevent movement of the door 12 when the door unlatching actuation mechanism 32 is placed in a latched condition.

In one non-limiting example, the door unlatching actuation mechanism 32 may include a fork bolt 36 movable between an unlatched position and a latched position to releasably capture the striker 34. A detent lever 37 is selectively moved by an actuator 38 between a latched position and an unlatched position. For example, when the actuator 38 moves the detent lever 37 into the latched position, the fork bolt 36 is placed in the latched position to capture the striker 34. When the actuator 38 moves the detent lever 37 into the unlatched position, the fork bolt 36 is placed in the unlatched position thus releasing the striker 34.

In another embodiment, the door unlatching actuation mechanism 32 may have at least three operational states. In a first operational state or a latched state, the door 12 is secured by the door unlatching actuation mechanism 32 to secure or latch the door 12 relative to the body 14 in a closed position such that the exterior door handle 18 is disabled and will not open the door 12 while the interior door handle may or may not be disabled. In a second operational state or unlatched state, wherein the door unlatching actuation mechanism 32 of the door 12 is unlatched and may be opened by both the interior door handle and the exterior door handle 18 such that the door 12 is free to move between the closed position and an open position relative to the body 14. In a third operational state or child locked state, the interior door handle may be disabled while the exterior door handle 18 is enabled such that door unlatching actuation mechanism 32 may be unlatched to allow the door 12 to be opened by the exterior door handle 18 but not by the interior door handle.

The door control system 30 additionally includes a controller 40 that may be operatively connected to and selectively actuate the door unlatching actuation mechanism 32 based at least partially on activation or actuation of one or more of the first or exterior door handle 18 and the second or interior door handle. The controller 40 may be, by way of non-limiting example, a body control module or a door control module. The controller 40 may be configured to receive and transmit signals, to process information and provide commands to systems and components to which the controller 40 is operatively connected or in communication.

The controller 40, as provided herein, may be operatively connected to or in communication with the interior door handle, exterior door handle 18, the window assembly 22, one or more devices, the door unlatching actuation mechanism 32, a window regulating mechanism, and various sensors and switches associated therewith. A door handle sensor 42 is in communication with the controller 40 and monitors activation or actuation of the exterior door handle 18 to detect whether an interior door handle and/or an exterior door handle 18 of a corresponding door 12 is operated from the interior or exterior of the vehicle 10. Controller 40 may also communicate with a door position sensor or door ajar switch 44.

The controller 40 may be embodied as one or multiple digital computers or host machines each having one or more processors, read only memory (ROM), random access memory (RAM), electrically-programmable read only memory (EPROM), optical drives, magnetic drives, etc., a high-speed clock, analog-to-digital (A/D) circuitry, digital-to-analog (D/A) circuitry, and required input/output (I/O) circuitry, I/O devices, and communication interfaces, as well as signal conditioning and buffer electronics. In certain embodiments, the controller 40 may also include incorporate one or more of the door handle sensor 42, door position sensor 44 and/or one or more other systems. In addition, it will be appreciated that the controller 40 may otherwise differ from the embodiment depicted in FIG. 2. For example, the controller 40 may be coupled to or may otherwise utilize one or more remote computer systems and/or other control systems.

The controller 40, in response to an open request signal transmitted by the door handle sensor 42 indicating activation or actuation of the handle 18, transmits a first control signal to the actuate the door unlatching actuation mechanism 32. The actuator 38 of door unlatching actuation mechanism 32, in response to the first control signal, disengages the striker 34 to allow the door 12 to be moved between the closed position and a fully opened position or any intermediate position therebetween. The open request signal generated by the door handle sensor 42 indicates an intent to open the door 12 and can be initiated, for example, by a user lifting a handle 18 of the door 12, a signal received from a door switch that has been activated by a user, or a signal received from a remote device that has been initiated by a user.

The door position sensor 44 is in communication with the controller 40. The controller 40 monitors the door position sensor 44 to detect if the door is in the closed position or at least one open position. Alternatively, the door position sensor or door ajar switch 44 may include a switch that cooperates with the detent lever 37 and actuator 38 to determine whether the door unlatching actuation mechanism 32 disengaged the striker 34.

Figure 3:
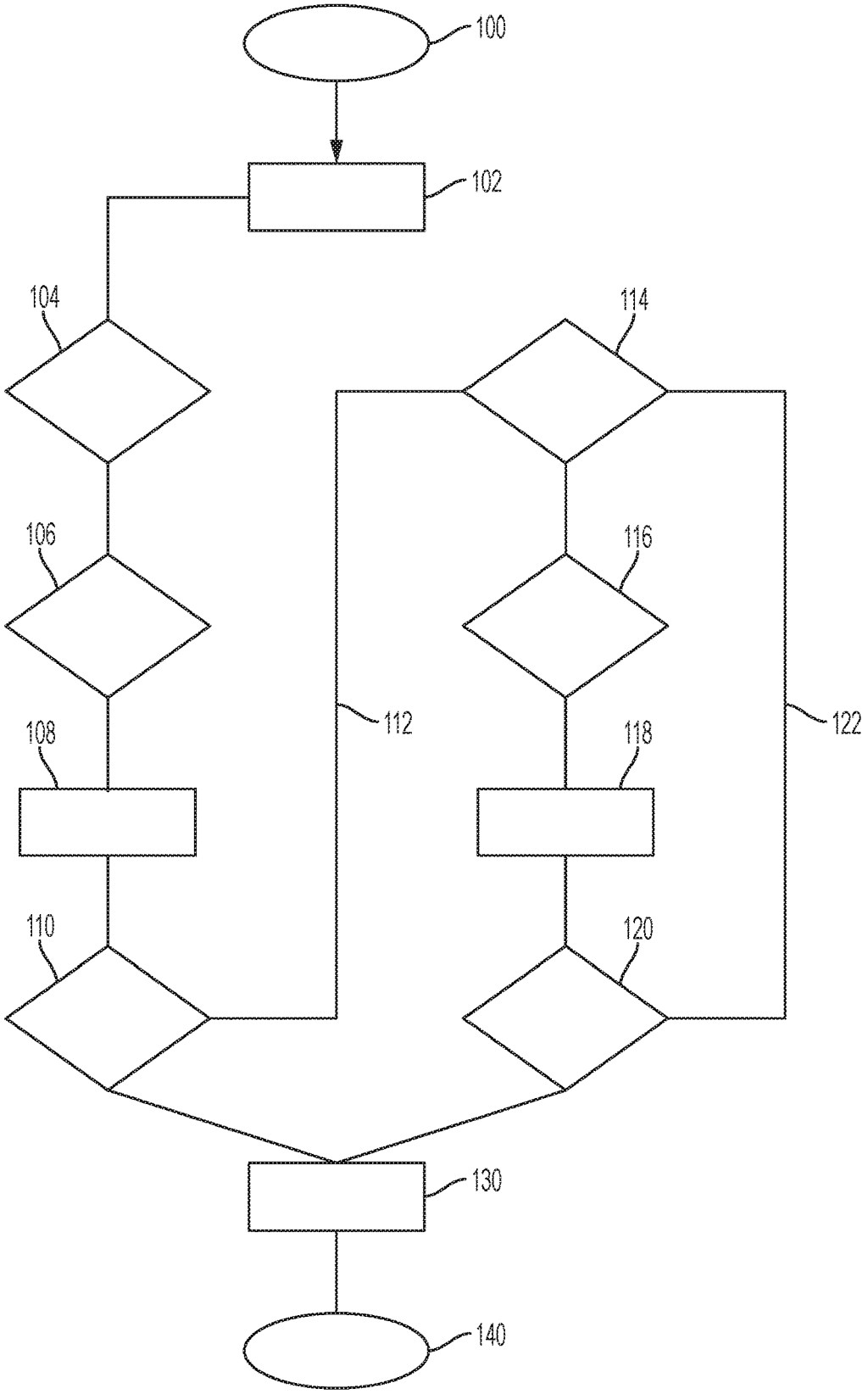
FIG. 3 is a flowchart of a method for controlling operation of a vehicle door assembly in accordance with the present disclosure.

Referring to FIG. 3, a method for use with the door control system is generally described. The method is generally referenced by numeral 100. It is understood that the teachings of method 100 may be described herein in terms of functional and/or logical block or box components and/or various processing steps. It should be realized that such block or box components may include one or more hardware, software, and/or firmware components configured to perform the specified functions. As can be appreciated in light of the disclosure, the order of operation within the method is not limited to the sequential execution as illustrated in FIG. 3, but may be performed in one or more varying orders as applicable and in accordance with the present disclosure. It is also understood that the method may be completed utilizing all or some of the steps described below.

The method may initiate at box 102, wherein a door operation counter is provided and is in communication with the controller. It is contemplated that the controller may set the value of door handle operation counter to zero in advance of a first door opening attempt. The door operation counter may determine a number N of open requests detected by the door handle sensor, wherein N is an integer greater than zero.

At box 104, the controller monitors the door handle sensor to detect actuation or activation of the door handle by a user indicating a first open request or first door opening attempt. If the controller does not receive a signal from the door handle sensor, the controller continues to monitor the door handle sensor. At box 106, the controller evaluates the door operation counter value to determine the number of open requests received from the door handle. If the door open request is a first attempt to actuate or activate the door unlatching actuation mechanism, then the operation counter value N equals one.

At box 108, the controller transmits a control signal to actuate the door unlatching actuation mechanism in response to the first open request from the door handle. The controller instructs the actuator of the door unlatching actuation mechanism to release the striker, allowing the vehicle door to be moved between a closed position and at least one open position. The control signal may be a timed pulse generated by the controller instructing the actuator to actuate, open or unlatch for the specified period of time T instructed by the timed pulse for the specified period of the timed pulse to allow the striker to be moved out of engagement with the fork bolt and detent lever of the latch.

In one embodiment, it is contemplated that the first time period or timed pulse T1 of the control signal to the actuator of the door unlatching actuation mechanism may be a first control signal of about 200 milliseconds in duration. The controller may generate a second control signal (or any other N number of times) to actuate the door unlatching actuation mechanism based upon subsequent open requests received from the door handle sensor where the door position sensor indicates that the door is not open or ajar as will be described in greater detail below.

At box 110, the controller monitors a door position sensor operatively connected to the door unlatching actuation mechanism to detect movement of the door between a closed position and at least one open position during the timed pulse of the control signal. If the door position sensor detects the door is moved from a closed position to at least one open position within the specified first time period T1 of the control signal, the door control system completes the process at box 130. If movement of the door is not detected by the door position sensor within the duration of the specified time T1 of the first control signal, the controller moves to box 114 to detect additional actuation or activation requests from the door handle as represented by line 112.

At box 114, the controller monitors the door handle sensor to detect further actuation or activation of the door handle by a user indicating additional door opening attempts. If the controller does not receive a signal from the door handle sensor, the controller continues to monitor the door handle sensor. At box 116, the controller evaluates the door operation counter value to determine the number of open requests received from the door handle. If the open request received from the door handle sensor is the second or greater attempt, then the counter value may be increased by a value of N. It is contemplated that N may be a number based upon a value of the door operation counter increased by a count of one in response to the door handle sensor activation or actuation (N+1).

For example, as is represented by box 118, the controller, in response receiving a second open request for the door handle sensor and the door operation counter value N being equal to or greater than two, transmits a second control signal to actuate the door unlatching actuation mechanism to instruct the actuator of the door unlatching actuation mechanism to release the striker, allowing the vehicle door to be moved between a closed position and at least one open position. The second control signal generated by the controller may be of an increased duration of time pulse as compared to the first control signal.

The second time period T2 used for the second control signal to actuate the door unlatching actuation mechanism may be the sum of the first time period T1 and a value X, wherein X is a time value measured in milliseconds. Said another way, the second control signal may result from an increase in time T by adding a X increment of milliseconds such that the second control signal is a second duration of time pulse based upon (T+X). In one non-limiting example, the value X of the increment of milliseconds added to the first time period T1 of about 200 milliseconds may be about 100 milliseconds, such that time period T2 of the second control signal may be about 300 milliseconds in duration. It is understood that the X increment of time may be a number of any duration and may be of a single duration time or may be adjusted incrementally by any known method.

At box 120, the controller monitors a door position sensor operatively connected to the door unlatching actuation mechanism detects movement of the door between a closed position and at least one open position during the timed pulse of the second time period T2 of the second control signal. If the door position sensor detects the door is moved from a closed position to at least one open position within the second time period T2 (T1+X) of the second control signal, the door control system completes the process at box 130. If movement of the door is not detected by the door position sensor within the specified second time period T2 of the second control signal, the controller returns to box 114 to detect additional actuation or activation requests from the door handle as represented by line 122.

In various embodiments, the number of control signals generated by the controller and transmitted to the door unlatching actuation mechanism of the door latch may be modified by every N number of open requests and adjusted to a specified time T+X wherein the value of X may be incrementally increased. For example, if the door position sensor does not detect movement of the door at box 120, the controller returns to box 114 to detect a third or other N number of open requests from the door handle sensor until the door position sensor detects that the door has moved from the closed position to the at least one open position at box 130, wherein the method ends at box 140.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A method of controlling at least one door of a vehicle, the method comprising:

monitoring, with a controller, a door handle sensor operatively connected to a door handle to detect at least one open request generated by the door handle;

providing a door operation counter in communication with the controller to determine a number N of open requests detected by the door handle sensor, wherein N is an integer greater than zero;

transmitting a first control signal with the controller to a door unlatching actuation mechanism in response to a first open request;

actuating the door unlatching actuation mechanism for a first time period T1 in response to the first control signal, wherein the controller transmits the first control signal to actuate the door unlatching actuation mechanism for the first time period T1 in response to the door operation counter N value of one;

monitoring, with the controller, a door position sensor operatively connected to the door unlatching actuation mechanism to detect movement of the door between a closed position and at least one open position;

determining the position of the door at completion of the first time period T1 with the door position sensory; and transmitting a second control signal with the controller to actuate the door unlatching actuation mechanism for a second time period T2 in response to the controller detecting a second open request from the door handle sensor and the controller detecting the door in the closed position with the door position sensor at the completion of the first time period T1.

2. The method of claim 1 wherein the first time period T1 used for the first control signal to actuate the door unlatching actuation mechanism is about 200 milliseconds.

3. The method of claim 1 wherein the controller transmits the second control signal to actuate the door unlatching actuation mechanism for the second time period T2 in response to the door operation counter N value of two.

4. The method of claim 3 wherein the second time period T2 used for the second control signal to actuate the door unlatching actuation mechanism is the first time period T1 increased by a value X, wherein X is a time value measured in milliseconds.

5. The method of claim 4 wherein the time value X used for the second time period T2 is about 100 milliseconds.

6. A method of controlling at least one door of a vehicle, the method comprising:

monitoring, with a controller, a door handle sensor operatively connected to a door handle to detect at least one open request generated by the door handle;

providing a door operation counter in communication with the controller to determine a number of open requests detected by the door handle sensor;

transmitting a first control signal with the controller to a door unlatching actuation mechanism in response to a first open request;

actuating the door unlatching actuation mechanism for a first time period T1 in response to the first control signal;

monitoring, with the controller, a door position sensor operatively connected to the door unlatching actuation mechanism to detect movement of the door between a closed position and at least one open position;

determining the position of the door at completion of the first time period T1 with the door position sensor; and transmitting a second control signal with the controller to actuate the door unlatching actuation mechanism for a second time period T2 in response to the controller detecting a second open request from the door handle sensor and the controller detecting the door in the closed position with the door position sensor at the completion of the first time period T1.

7. The method of claim 6 wherein the door operation counter in communication with the controller determines a number N of open requests detected by the door handle sensor, wherein N is an integer greater than zero.

8. The method of claim 7 wherein the controller transmits the first control signal to actuate the door unlatching actuation mechanism for the first time period in response to the door operation counter N value of one.

9. The method of claim 8 wherein the first time period T1 used for the first control signal to actuate the door unlatching actuation mechanism is about 200 milliseconds.

10. The method of claim 7 wherein the controller transmits the second control signal to actuate the door unlatching actuation mechanism for the second time period T2 in response to the door operation counter N value of two.

11. The method of claim 10 wherein the second time period T2 used for the second control signal to actuate the door unlatching actuation mechanism is the first time period T1 increased by a value X, wherein X is a time value measured in milliseconds.

12. The method of claim 11 wherein the time value X used for the second time period T2 is about 100 milliseconds.

13. A door unlatching system for a vehicle having a vehicle body defining a vehicle interior and a plurality of doors configured to selectively open and close at least one entryway into the vehicle interior, the door unlatching system comprising:

a door handle disposed on each of the plurality of doors;

a door unlatching actuation mechanism operatively connected to the door handle and coupled to each of the plurality of doors;

a controller operatively connected with the door handle and door unlatching actuation mechanism;

a plurality of sensors in communication with the controller, the plurality of sensors includes a door handle sensor monitoring actuation of the door handle and a door position sensor monitoring the position of the door between the closed and open position; and a door operation counter in communication with the controller to determine a number N of open requests detected by the door handle sensor, wherein N is an integer greater than zero, wherein the controller:

monitors the door handle sensor to detect at least one open request generated by the door handle, transmits a first control signal to the door unlatching actuation mechanism in response to a first open request, actuates the door unlatching actuation mechanism for a first time period T1 in response to the first control signal, monitors the door position sensor to detect movement of the door between a closed position and at least one open position, and determines the position of the door at completion of the first time period T1 with the door position sensor.

14. The door unlatching system of claim 13 wherein the first time period T1 used for the first control signal to actuate the door unlatching actuation mechanism is about 200 milliseconds.

15. The door unlatching system of claim 13 wherein the controller transmits a second control signal to actuate the door unlatching actuation mechanism for a second time period T2 in response to a second open request from the door handle sensor when the door position sensor detects the door in the closed position at the completion of the first time period T1.

16. The door unlatching system of claim 15 wherein the controller transmits the second control signal to actuate the door unlatching actuation mechanism for the second time period T2 in response to the door operation counter N value of two.

17. The door unlatching system of claim 16 wherein the second time period T2 used for the second control signal to actuate the door unlatching actuation mechanism is the first time period T1 increased by a value X, wherein X is a time value measured in milliseconds and the time value X used for the second time period T2 is about 100 milliseconds.

* * * * *